US005346277A

United States Patent [19]

Holobaugh et al.

[11] Patent Number: 5,346,277

[45] Date of Patent: Sep. 13, 1994

[54] FOLDABLE HEADREST MECHANISM

[75] Inventors: Raymond E. Holobaugh, Jamestown; W. Clark Rogers, Denton, both of N.C.

[73] Assignee: Parma Corporation, Denton, N.C.

[21] Appl. No.: 922,627

[22] Filed: Jul. 30, 1992

[51] Int. Cl.[5] ..... A47C 1/02

[52] U.S. Cl. ..... 297/61; 297/396; 297/403

[58] Field of Search ..... 297/61, 391, 396, 403, 297/408

[56] References Cited

U.S. PATENT DOCUMENTS

| | | | |
|---|---|---|---|
| 2,984,293 | 5/1961 | Bontempi et al. | 297/61 |
| 3,074,758 | 1/1963 | Schliephacke | 297/61 |
| 3,652,125 | 3/1972 | Rogers, Jr. | 297/403 |
| 3,844,607 | 10/1974 | Ré | 297/403 X |
| 3,942,835 | 3/1976 | Harrison | 297/403 X |
| 4,188,062 | 2/1980 | Rogers, Jr. et al. | 297/403 X |
| 4,691,961 | 9/1987 | Rogers, Jr. et al. | 297/61 |
| 4,830,429 | 5/1989 | Petitjean | 297/61 |
| 5,044,692 | 9/1991 | Tidwell, Jr. et al. | 297/403 X |

OTHER PUBLICATIONS

Drawing of *Assembly Detail for Add-On Headrest*, Parma Corporation, P. O. Box 728, Denton, N.C. 27239-0728.

*Primary Examiner*—Peter M. Cuomo
*Assistant Examiner*—Suzanne L. Dino
*Attorney, Agent, or Firm*—Bell, Seltzer, Park & Gibson

[57] ABSTRACT

A headrest mechanism suitable for use in a seating unit comprising a headrest plate movable between a retracted position and an extended position having a lower front edge, means for actuating the headrest plate between the retracted position and the extended position pivotally interconnected to the headrest plate, and means for fixedly mounting the headrest mechanism onto the seating unit pivotally connected to the actuating means is disclosed. In the retracted position, the headrest plate is disposed generally horizontally, with the lower front edge being separated from a fixed point on the mounting means by a first distance, and in the extended position, the headrest plate is disposed generally vertically, with the lower edge being separated from the same fixed point on the mounting means by a second distance, the second distance being substantially greater than the first distance.

31 Claims, 5 Drawing Sheets

FOLDABLE HEADREST MECHANISM

FIELD OF THE INVENTION

This invention relates generally to headrest mechanisms suitable for use in conjunction with a seating unit, and more specifically relates to foldable headrest mechanisms suitable for use in a reclining seating unit.

BACKGROUND OF THE INVENTION

Retractable headrests suitable for use with chairs, sofas, and other seating units are known. Such headrests are generally movable from a retracted position to an extended position atop the upper edge of the backrest of the seating unit. The prior art discloses a headrest that retracts to a position within the backrest of a chair, see, e.g., Bontempi et al., U.S. Pat. No. 2,984,293, a headrest that folds within a cavity in the rear surface of the backrest, see, e.g., Rogers, U.S. Pat. No. 3,652,125, and a headrest which overlies the upper edge of the backrest, see, e.g., Rogers, U.S. Pat. No. 4,691,961.

A headrest which overlies the backrest (a "horizontal" headrest) has some distinct advantages over other known headrest types. The backrest profile can be relatively thin, as the backrest is not required to house the entire thickness of the headrest within its profile when retracted. The back surface of the chair can be placed immediately adjacent the wall without the wall interfering with the operation of the backrest. The headrest can be visually integrated with the backrest through a single piece of upholstery fabric without the unsightly seam or gap inherently present in headrests retracting within the backrest. Finally, when extended, the horizontal headrest has no exposed linkage members visible from the front of the chair to detract from the appearance of the chair.

While the advantages of the horizontal headrest are many, horizontal headrests have certain shortcomings. One deficiency is the low height of the extended headrest. Certain furniture styles require a low backrest height for seating units. The prior art fails to disclose a horizontal headrest which extends sufficiently above the backrest to compensate for the lower backrest height. The problem is compounded in that, from a practical sense, the headrest height is limited to the thickness of the upper edge of the backrest; otherwise, the appearance of the chair is adversely affected. The same modern furniture styles that call for low backrest height also commonly call for relatively thin backrests. A second related deficiency is the unsightly "blousing" of upholstery covering the backrest and headrest when the headrest is in the extended position. A single piece of upholstery fabric covering the headrest and backrest reaches from an attachment point on the back edge of the headrest to some attachment point on the front side of the backrest, and is most likely fixed at the lowest front edge of the backrest. In horizontal headrests disclosed in the prior art, the length of upholstery cloth required to reach between these attachment points is greater when the headrest is in the retracted position than when it is in the extended position. Consequently, the upholstery material is not taut in the extended position and "blouses" along the upper edge of the backrest. This bloused material is unsightly and bothersome to the occupant.

The prior art fails to show a horizontal headrest which satisfactorily suggests how to extend headrest height or prevent upholstery blousing. Consequently, it is an object of the present invention to provide a horizontal headrest that extends to a greater height than that previously seen. It is an additional object of the present invention to provide a horizontal headrest which extends to a height sufficient to maintain upholstery covering the headrest and the backrest in a taut condition.

SUMMARY OF THE INVENTION

These and other objects are satisfied by the present invention which includes as a first aspect a headrest mechanism suitable for use in a seating unit comprising a headrest plate movable between a retracted position and an extended position having a lower front edge, means for actuating the headrest plate between the retracted position and the extended position pivotally interconnected to the headrest plate, and means for fixedly mounting the headrest mechanism onto the seating unit pivotally connected to the actuating means. In the retracted position, the headrest plate is disposed generally horizontally, with the lower front edge of the headrest being separated from a fixed point on the mounting means by a first distance, and in the extended position, the headrest plate is disposed generally vertically, with its lower edge being separated from the same fixed point on the mounting means by a second distance, the second distance being substantially greater than the first distance. In a preferred embodiment, the headrest mechanism is configured so that the second distance is between about 2.5 and 6 inches greater than the first distance.

The present invention includes as a second aspect a seating unit comprising a frame including a backrest having an upper edge, a seat, and a base, a headrest plate movable between a retracted position and an extended position having a lower front edge, means for actuating the headrest plate between the retracted position and the extended position pivotally interconnected to the headrest plate, and means for fixedly mounting the headrest mechanism onto the frame pivotally interconnected to the actuating means. In the retracted position, the headrest plate is disposed generally horizontally and adjacently overlying the upper edge of the backrest, and in the extended position, the headrest plate is disposed generally vertically, with the lower front edge of the headrest plate being separated from the upper edge of the backrest by a substantial gap. In a present embodiment, the seating unit includes means for reclining the chair to TV and fully reclined positions, and means for coupling the actuating means with the reclining means so that the headrest is extended when the chair is in the TV and fully reclined positions.

DETAILED DESCRIPTION OF THE INVENTION

The present invention is directed to a horizontal headrest movable between a generally horizontal retracted position atop of the upper edge of a seating unit backrest and a generally vertical extended position above the upper edge of the seating unit. In the extended position, the headrest is separated from the upper edge of the chair sufficiently to (a) retain in a taut condition a single piece of upholstery fabric covering both the headrest and the backrest; and (b) provide a comfortable head support for an occupant when the headrest is included in a seating unit with a low backrest height.

The present invention will now be described more fully hereinafter. This invention may be embodied in many forms and should not be construed as limited to the embodiments set forth herein; instead, these embodiments are provided so that this disclosure will be thorough and complete, and will fully convey the scope of the invention to those skilled in the art.

The following definitions of terms known in this art will facilitate a more complete understanding of the invention. As used herein, "upright position" means the position of a recliner chair which exists when the chair is unoccupied, with the backrest in its most upright position and with the footrest retracted beneath the seat. "Fully reclined position" means the position of a recliner chair in which the backrest has been reclined to its shallowest angle relative to the floor. "TV position" means an intermediate reclined position in a recliner chair where the footrest is projected forwardly from the chair while the backrest is in an upright position or in a substantially upright position. A "one-way" recliner means a chair which includes a seat and headrest rigidly fixed to one another, and which is movable between an upright and a fully reclined position. A "two-way" recliner means a recliner chair which includes a seat and backrest which are rigidly fixed to each other to always move together and which is movable between an upright position, a TV position, and a fully reclined position. A "three-way" recliner means a recliner chair for which the backrest may pivot into reclining positions relative to the seat, which also is capable of moving into reclining positions relative to a fixed base, the angle between the backrest and seat being variable in different reclining positions, and which is movable between an upright position, a TV position, and a fully reclined position. A "wall-avoiding" recliner means a type of recliner chair wherein, as the chair moves to a reclining position, the backrest of the chair also moves forwardly, so that if the backrest of the chair is placed substantially adjacent a wall, the backrest will not strike the wall during reclining or retraction of the chair.

Figure 1:
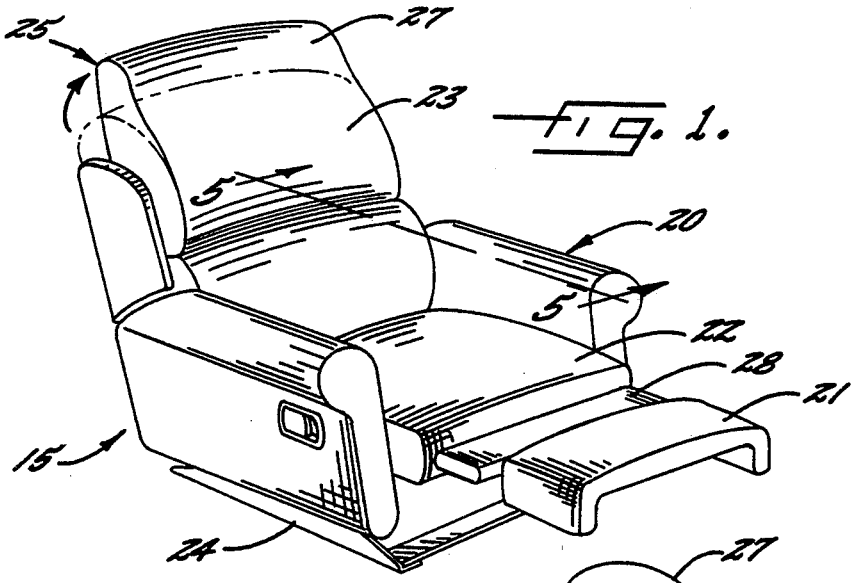
FIG. 1 is a perspective view of a reclining chair with its footrest extended.
Figure 2:
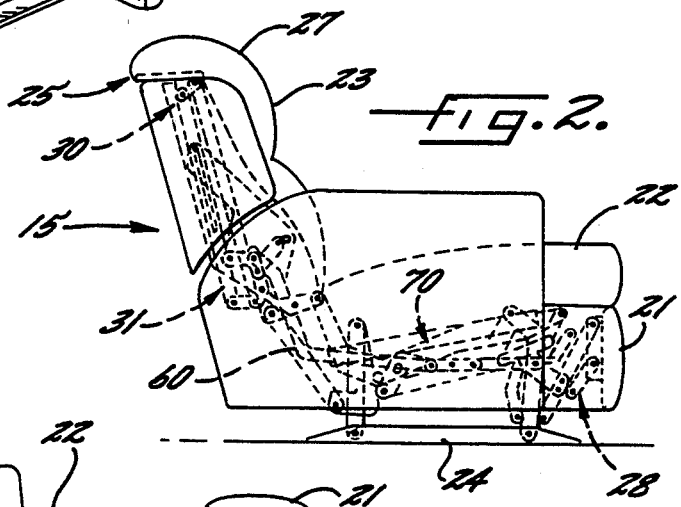
FIG. 2 is a side elevation view of a reclining chair in the upright position.

Referring now to the drawings, a three-way reclining chair designated generally at 15 is shown in FIG. 1. The chair 15 comprises a seat frame 20, a base 24 which supports the seat frame 20, and a horizontal headrest mechanism 25. The seat frame 20 comprises a seat 22, a footrest 21 attached to the chair by a footrest extension linkage 28, and a backrest 23. As this is a three-way recliner, the backrest 23, which includes side panels 26 (FIG. 5), is pivotable about the seat 22 at pivot 19 so that the chair is movable between an upright position shown in FIG. 2, an intermediate TV position shown in FIG. 3, and a fully reclined position shown in FIG. 4. The movement of the seat 22 and the backrest 23 relative to one another and to the base 24 is controlled by a reclining linkage 70 which pivotally interconnects the seat frame 20 to the base 24. The footrest 21 is movable through actuation of the footrest linkage 28 between a retracted position beneath the seat 22 (in the upright position) and an extended position forward of the seat 22 (in the TV and fully reclined position). Although a wall-avoiding three-way reclining chair is shown, those skilled in this art will understand that the headrest mechanism 25 is suitable for use in non-reclining seating units and reclining seating units, including one-way, two-way, and three way recliners of both wall-avoiding and non-wall avoiding types.

Figures 5, 6:
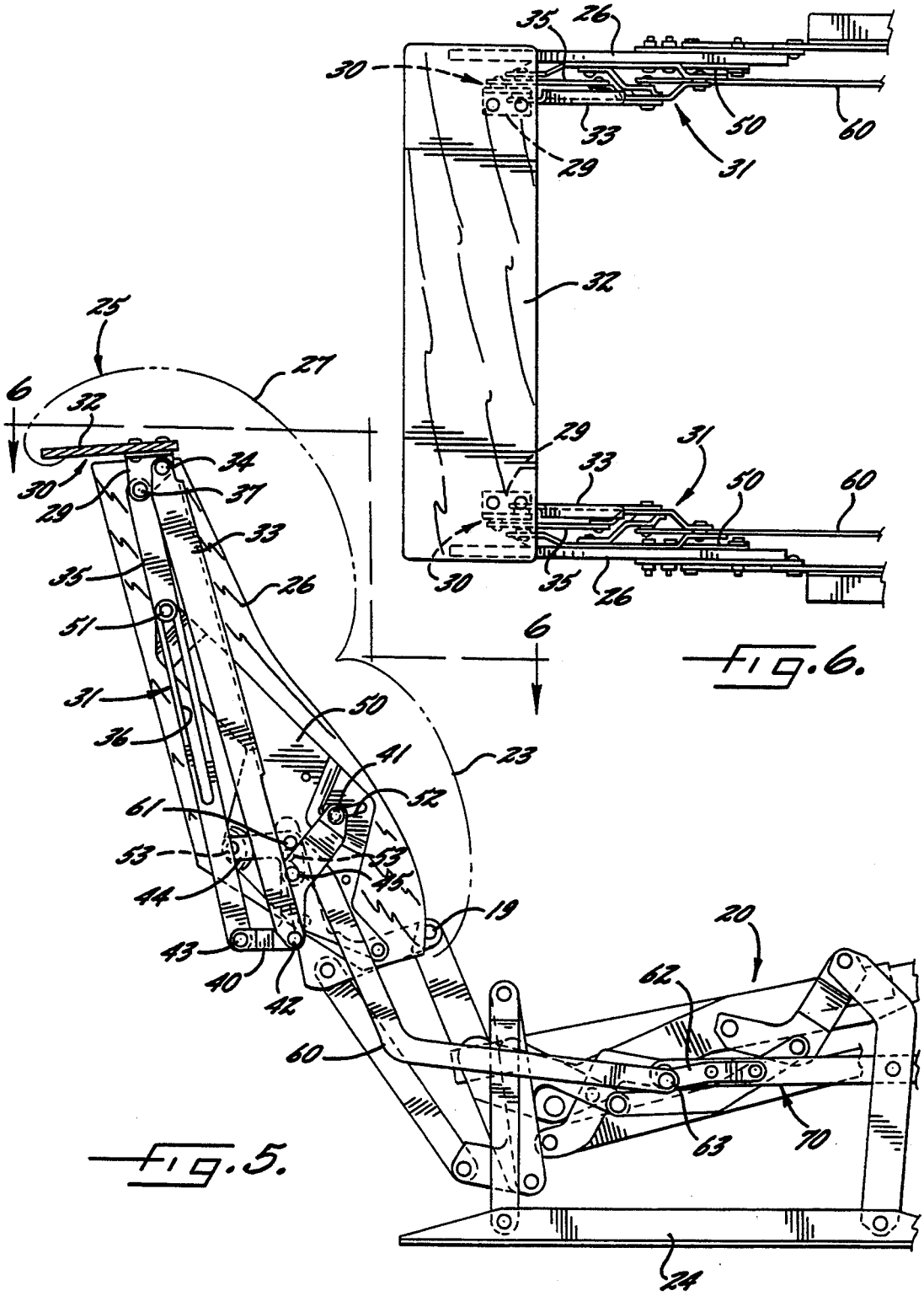
FIG. 5 is a view taken along line 5—5 of FIG. 1 showing a headrest mechanism in the retracted position.
FIG. 6 is a view taken along line 6—6 of FIG. 5 showing headrest mechanisms on each side of a chair.
Figure 7:
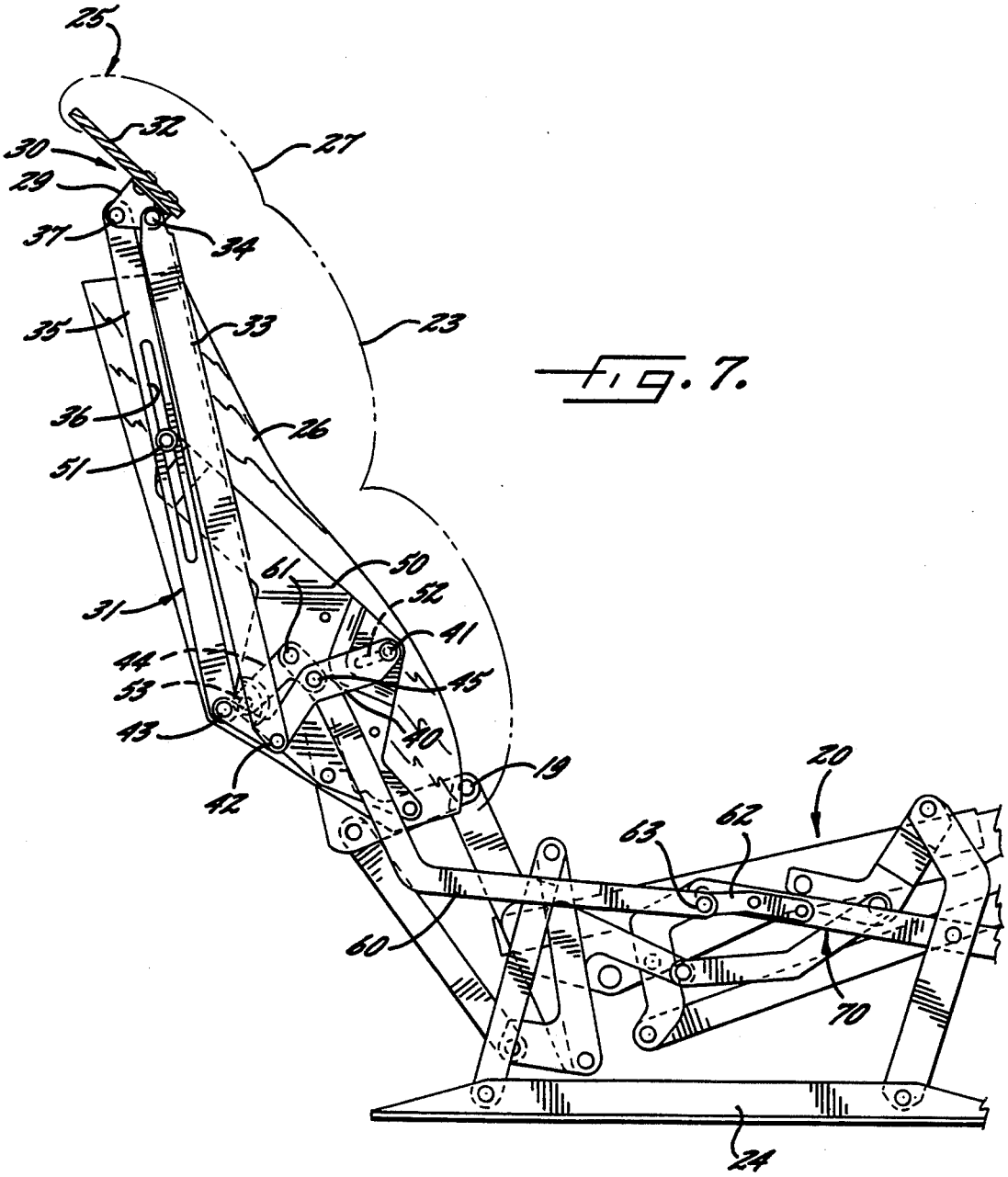
FIG. 7 is a side elevation view showing the headrest in a position between the retracted and the extended positions.
Figures 8, 9:
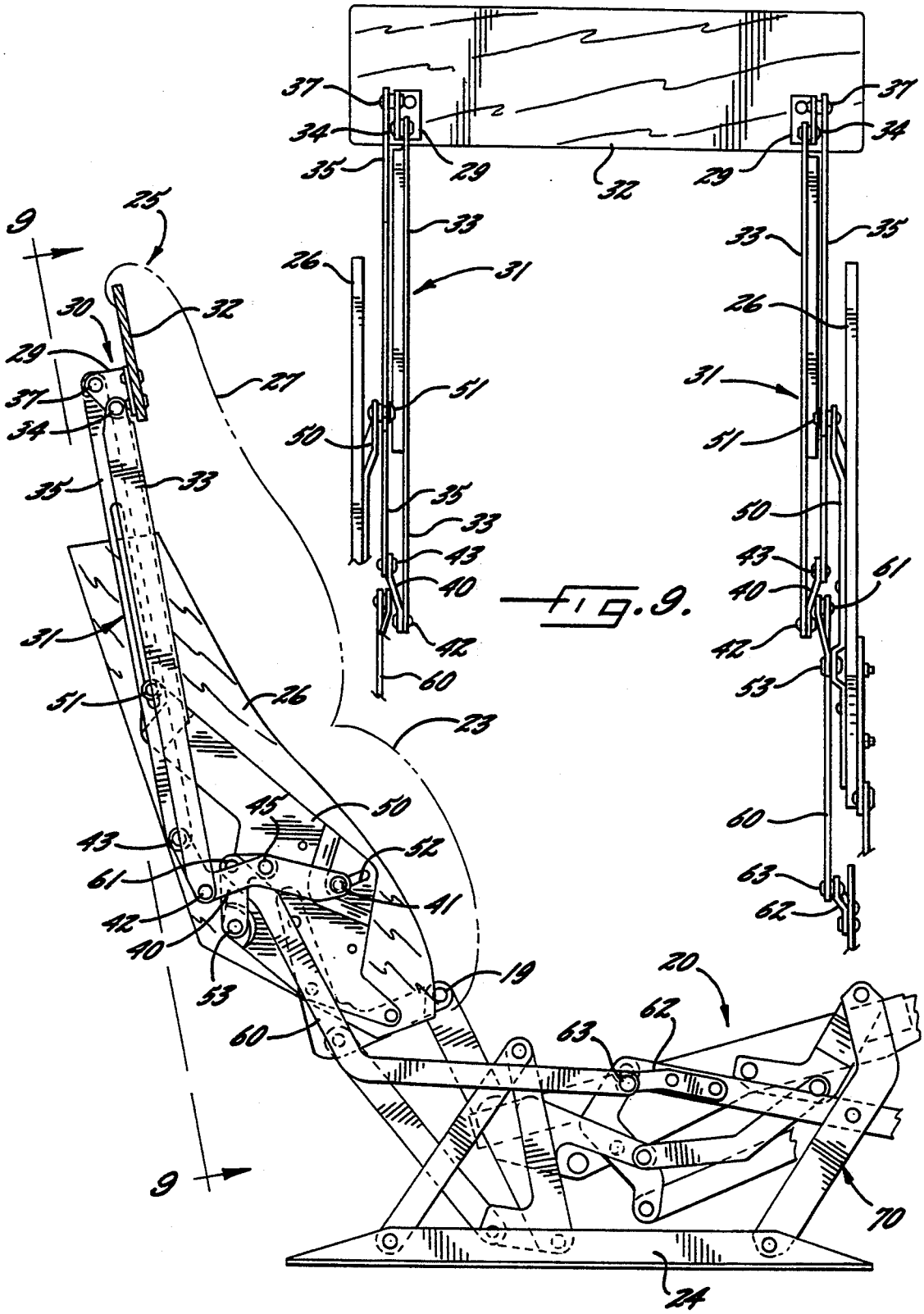
FIG. 8 is a side elevation view showing the headrest in the fully extended position.
FIG. 9 is a view taken along line 9—9 of FIG. 8 showing the headrest in the fully extended position.

The headrest mechanism 25, shown in FIGS. 5, 7 and 8, comprises a headrest plate assembly 30, a pair of actuating units 31, and a pair of mounting plates 50. As indicated in FIGS. 6 and 9, the actuating units 31 and mounting plates 50 are mirror images of each other; for clarity of explanation, only one of each will be described in detail. A single piece of upholstery fabric 27 covers the headrest assembly 25 and the front surface of the backrest 23; the upholstery fabric 27 is fixed to the lower rear edge of the headrest plate 32 and beneath the front lower edge of the backrest 23 and is sized to remain taut as it covers the front surfaces of the backrest 23 and the headrest 25.

The mounting plate 50 is fixed to the interior of the backrest side panel 26 of the backrest 23 (FIG. 6). The mounting plate 50 includes a slot 52 near its forward edge, a pivot 53 near its rearmost edge, and a pin 51 toward its uppermost edge as mounting locations for the actuating unit 31. Those skilled in this art will appreciate that any type of mounting means, such as the mounting of pivot points of the actuating unit 31 directly to the backrest side panel 26, which fixes these pivot points to the appropriate locations on the backrest side panel 26 are suitable for use with the invention.

The actuating unit 31 (shown in the retracted position in FIG. 5) comprises a front extension link 33, a rear extension link 35, an elevating link 40, a bell crank 44, a driving link 60, and a coupling bracket 62. The coupling bracket 62 is fixed at its forwardmost end to the reclining linkage 70 at a point beneath the seat 22. The dogleg-shaped drive link 60 is pivotally interconnected at its forwardmost end to the coupling bracket at pivot 63; the driving link 60 extends rearward substantially horizontally, then slopes upward and rearward approximately parallel the profile of the backrest 23. The driving link 60 pivotally interconnects at its rearmost end to the L-shaped bell crank 44 at pivot 61, which is located at the vertex of the bell crank 44. The bell crank 44 is also pivotally interconnected on one end to the mounting plate 50 at pivot 53, and at the other end to the elevating link 40 at pivot 45. The elevating link 40 is pivotally and slidably interconnected at its forwardmost end to the mounting plate 50 at slot 52 by pin 41. The elevating link 40 is also pivotally interconnected at its rearmost end to the lowermost portion of the rear extension link 35 at pivot 43. Intermediate of pivots 43 and 45 on the elevating link 40 is pivot 42, which interconnects the elevating link 40 to the lowermost front extension link 33. The rear extension link 35 is pivotally interconnected at its uppermost end to the headrest assembly 30 at pivot 37. The rear extension link 35 also includes slot 36, which is adapted for pivotal and sliding motion of the rear extension link 35 about the pin 51 of the mounting plate 50. The front extension link is pivotally interconnected at its uppermost end to the headrest assembly 30 at pivot 34.

The headrest assembly 30 comprises a headrest plate 32 and a mounting bracket 29 fixed to the underside of the headrest plate 32. The mounting bracket 29 includes pivots 37 and 34 which pivotally connect the mounting bracket to, respectively, the rear and front extension links 33, 35. Pivot 37 is located slightly downwardly and rearwardly of pivot 34. The headrest plate 32 is sized to be visually integrated with the upper edge of the backrest 23.

The headrest is actuated from its retracted position (FIG. 5) through an intermediate position (FIG. 7) to its extended position (FIG. 8) in response to movement of the reclining linkage 70 from upright to TV position, although those skilled in this art will appreciate that any reclining linkage means that will cause the rearmost end of the driving link 60 to move upward and rearward, thereby causing the remainder links of the actuating unit 31 to operate, is suitable for use in the invention.

As the driving link 60 moves from its lowered position in FIG. 5 to its slightly rearward and raised position of FIG. 7, the driving link 60 drives the bell crank 44 upward and rearward about pivot 53. This rotation of the bell crank 44 causes the pin 41 of the elevating link 40 to slide to the forwardmost end of the slot 52 of the mounting plate 50, and also causes the rearward end of the elevating link 40 to rise. The pivotal action of the elevating link 40 forces the rear extension link 35 and the front extension link 33 to ascend substantially parallel to one another and to the profile of the backrest 23 and lift the headrest assembly 30 from its retracted horizontal position overlying the upper edge of the headrest 23. Because pivot 42, which attaches the front extension link 33 to the elevating link 40, is located closer to pin 41 than pivot 43, which attaches the rear extension link 35 to the elevating link 40, the rear extension link 35 rises slightly more than the front extension link 33 in response to the pivotal movement of the elevating link 40, thereby causing the headrest assembly 30 to tilt from horizontal toward vertical as it rises. Those skilled in this art will appreciate that any means which can rotate the elevating link 40 about a pivot connected with the forward portion of the mounting plate 50 will cause the front and rear extension links 33, 35 to translate substantially parallel the profile of the backrest 23, and will also cause the rear extension link 35 to translate a distance sufficiently greater than that of the front extension link 33 to tilt the headrest assembly 30 to a predetermined position; such pivoting means would therefore be suitable for use in the invention.

As the extension of the headrest mechanism 25 continues to the fully extended position of FIG. 8, the driving link 60 continues to drive the vertex of the bell crank 44 upward and rearward, which motion causes the pin 41 of the elevating link 40 to move to the same rearward position in slot 52 as in the closed position. Simultaneously, pivots 42 and 43 are moved rearward and upward; again, the closer proximity of the pivot 42 to the pin 41 than that of the pivot 43 causes the rear extension link 35 to rise more than the front extension link 33, thereby causing the mounting bracket 29 and the headrest plate 32 to tilt forward to the generally vertical, extended position substantially parallel with the profile of the backrest 23. The lateral, i.e., forward and rearward, movement of the front extension link 33 and the rear extension link 35 should be controlled to ensure substantially vertical extension and retraction of the mechanism so that the headrest is properly positioned in the extended position. In this embodiment, the interconnection of the pin 51 in the slot 36 performs this controlling function, although those skilled in this art will appreciate that any means which would properly control the lateral movement of the front and rear extension links 33, 35, without interfering with the extension of these links is suitable.

FIG. 8 illustrates that in the fully extended position, the lower edge of the headrest plate 30 is separated from the upper edge of the backrest 23 by a substantial gap. It is the ability of the headrest plate to create this substantial gap that provides the chair with the desirable capacity to maintain the upholstery fabric 27 extending from the backrest 23 to the headrest 25 in a taut condition, without any unsightly blousing, folding, or billowing, in the extended position. The ability to extend sufficiently to form this substantial gap also provides a designer with the option of using a horizontal headrest on the type of low-backed seating unit often demanded for modern furniture styling, and to do so while maintaining a relatively narrow backrest profile. Preferably, the gap between the upper edge of the backrest 23 and the lower edge of the headrest plate 32 is between about 2.5 inches and 6 inches; more preferably, the gap is between 3 inches and 4 inches.

Those skilled in the art will appreciate that the actuating assembly 31 can be mounted on the mounting plate 50 in any manner that properly positions the headrest plate 32 to adjacently overlie the upper edge of the backrest 23 in the retracted position. This position will vary for different seating unit styles. For example, the position of the mounting plate 50 in the illustrated embodiment is dictated by the configuration of the reclining mechanism 70. However, for any configuration, a first distance can be defined between the lower front edge of the headrest plate 32 and any fixed point on the mounting plate 50, and a second distance can be defined between the same points in the extended position. In suitable embodiments of the invention, the second distance is substantially greater than the first distance. Preferably, the second distance is between about 2.5 inches and 6 inches greater than the second distance; more preferably, the second distance is between about 3 inches to 4 inches greater than the first distance.

Figure 3:
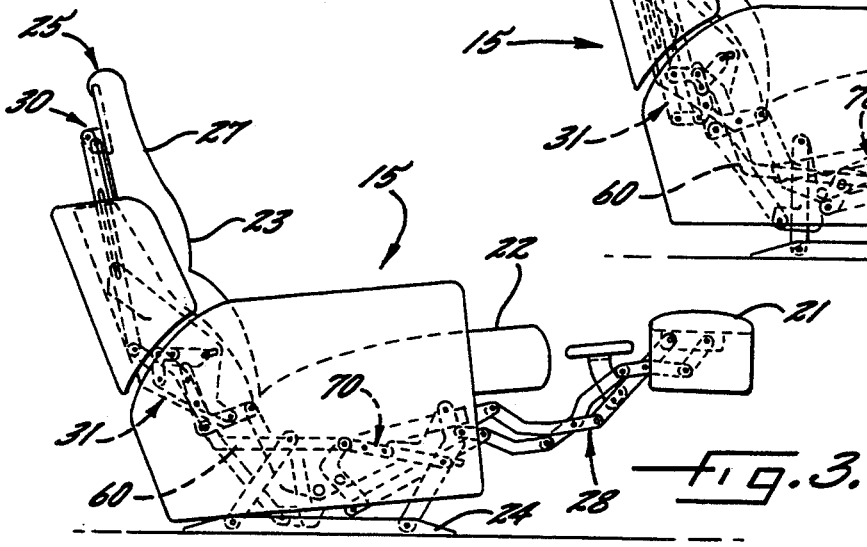
FIG. 3 is a side elevation view of a reclining chair in the TV position with the headrest extended.
Figure 4:
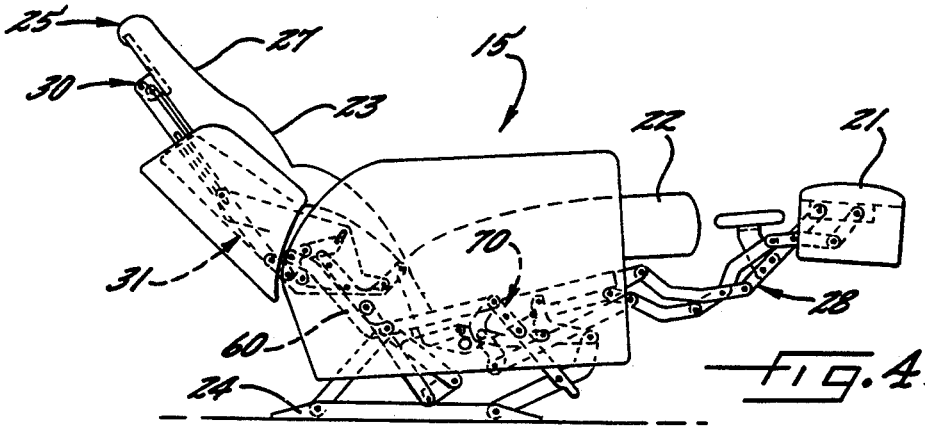
FIG. 4 is a side elevation view of a reclining chair in the fully reclined position with the headrest extended.

As illustrated in FIGS. 3 and 4, the headrest 25 remains extended as the recliner chair 25 reclines from the TV position to the fully reclined position. This requires timing the movement of the reclining means 70 as the chair 20 moves from the TV position to the fully reclined position so that the thrust force at the pivot 61 is essentially zero; with no thrust force at this pivot, the remainder of the actuating unit 31 remains in the extended configuration. Retention of the headrest 25 in the upright position is achieved by timing the pivoting of the backrest 23 and the seat 22 about the pivot 19 so that the distance between the pivot 61 and the pivot 19 remains essentially constant during this reclining motion, and the distance between the pivot 63 and the pivot 19 also remains essentially constant during this motion.

Figure 10:
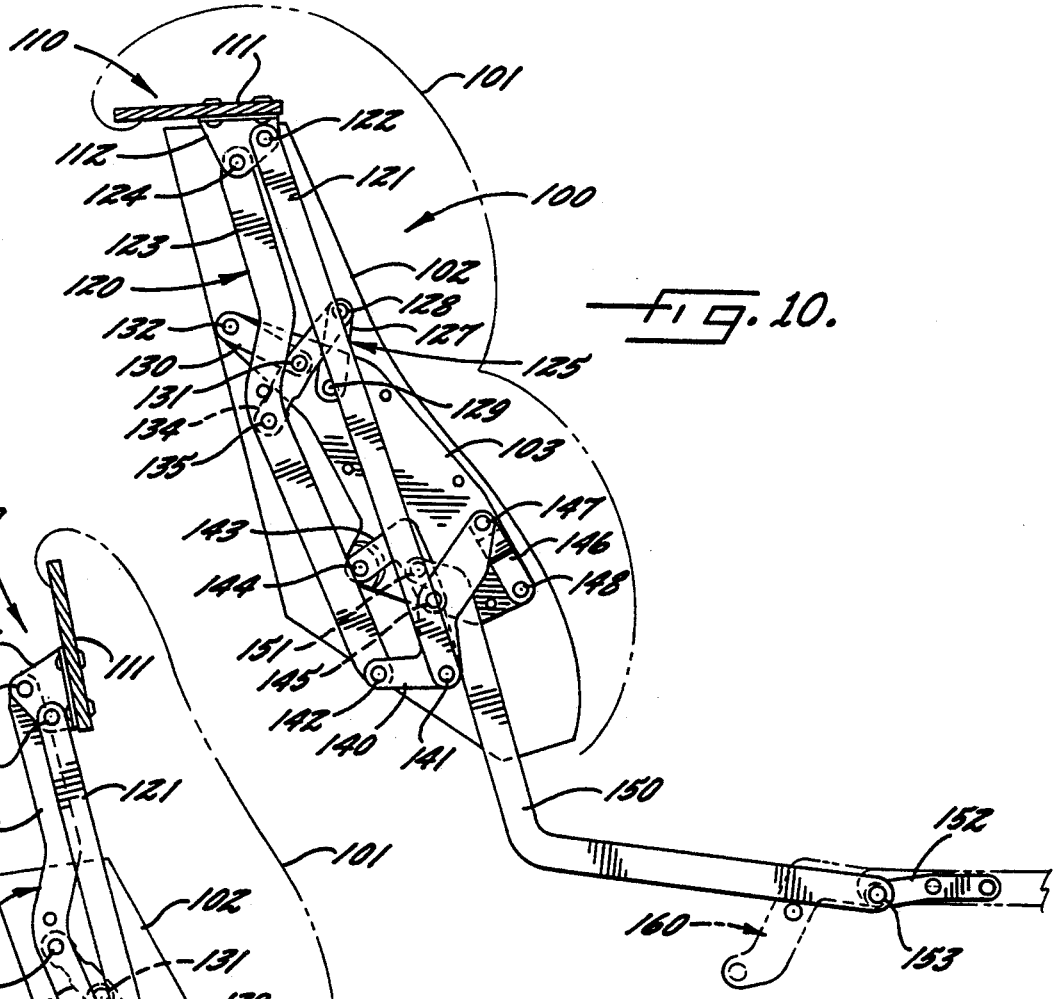
FIG. 10 is a side elevation view of an alternative embodiment of the headrest in the retracted position.
Figure 11:
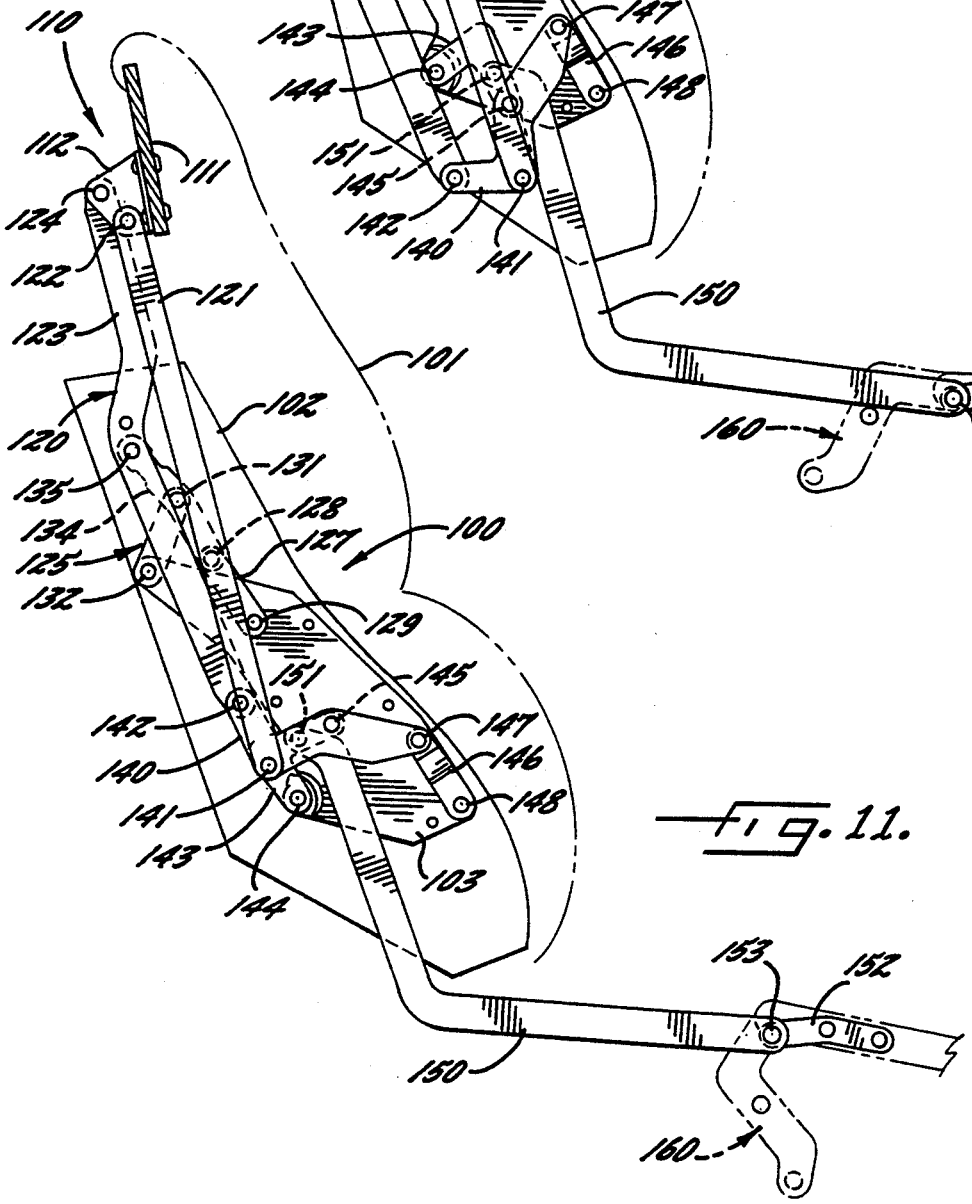
FIG. 11 is a side elevation view of the headrest of FIG. 10 in the extended position.

Another embodiment of the invention is shown in FIGS. 10 and 11. In this embodiment, the headrest mechanism 100 is illustrated fixed to a backrest side rail 102 by a mounting plate 103. A single piece of upholstery fabric 101 extends from the lower front edge of the backrest (not fully shown) of the seating unit to a fixed attachment underneath the rearmost edge of headrest plate 111.

The headrest mechanism 100 comprises a headrest plate assembly 110, and a actuating assembly 120. The mounting plate 103 is fixed to the backrest side rail and provides fixed pivot points 132, 129, 148, and 144 for interconnection with the actuating assembly 120. Those skilled in this art will appreciate that any type of mounting means which fixes the pivot points of the actuating assembly 120 to appropriate locations on the backrest side rail 102 is suitable.

The headrest plate assembly 100 comprises a headrest plate 111 and a mounting bracket 112. The headrest plate 111 is sized to be visually integrated with the upper edge of the backrest. The mounting bracket 112 is fixed to the underside of the headrest plate 111 and includes pivot points 122 and 124 for interconnection with the actuating assembly 120.

The actuating assembly 120 comprises a front extension link 121, a rear extension link 123, an elevating link 140, and a bell crank 143, each of which is quite similar to those seen in the embodiment of FIGS. 1–9. This embodiment also comprises a control linkage 125 and a lower control link 146 for controlling the lateral, i.e., forward and rearward, movement of the front and rear extension links 121, 123. The front extension link 121 is attached at its upper end at pivot 122 to the front portion of the mounting bracket 112. The rear extension link is attached at its upper end at pivot 124 to the mounting bracket rearward and downward of pivot 122. The front and rear extension links 121, 123 extend from these pivots 122, 124 to pivots 141 and 142, respectively, on the rearward portion of the elevating link 140. The elevating link 140 is also pivotally attached on its forwardmost end at pivot 147 to the lower control link 146 and at pivot 145 to the bell crank 143 intermediate of pivots 147 and 141. The lower control link 146 is pivotally attached on its end opposite pivot 147 to the mounting plate 103 at pivot 148. The V-shaped bell crank 143 is pivotally attached at its end opposite pivot 145 to the mounting plate 103 at pivot 144. The bell crank 143 is also pivotally attached to the rearward end of a dogleg-shaped drive link 150 at pivot 151. The drive link 150 is pivotally attached at its forward end to a coupling bracket 152 at pivot 153; the coupling bracket is fixed to the reclining linkage 160. Those skilled in this art will appreciate that, although the illustrated drive link 150 and coupling bracket 152 are adapted for use in a three-way recliner, the mechanism is also suitable for use in one-way and two-way recliners, including wall-avoiding and non-wall-avoiding models, and is even suitable for non-reclining seating units.

The control assembly 125 comprises a first upper control link 127, a second upper control link 130, and a transition link 134. The first upper control link is pivotally attached at 129 to the mounting plate 103 and also to the transition link 134 at pivot 128. The transition link 134 is pivotally attached at its opposite end to the rear extension link 123 at pivot 135. The second upper control link 130 is pivotally attached to the transition link 134 at pivot 131 intermediate of pivots 135 and 128 and is pivotally attached at its opposite end to the mounting plate 103 at pivot 132.

In operation, the headrest mechanism begins in a first retracted position shown in FIG. 10, wherein the headrest plate 111 is disposed generally horizontally and overlies adjacently the upper edge of the backrest side rail 102. As the reclining linkage 160 is actuated to move from an upright to a TV position, the upward and rearward movement of the coupling bracket 152 causes the drive link 150 to move similarly upward and rearward. This movement drives bell crank 143 upward and rearward about pivot 144, which in turn raises the rear portion of the elevating link 140. Pivot 147 on the forward end of the elevating link 140 moves forward slightly in response to this action, then returns to essentially its original position as the rear portion to the elevating link 140 continues to ascend. Both the rear extension link 123 and the front extension link 121 are elevated by the elevating link 140 until they protrude substantially beyond the upper edge of the backrest side rail 102. The closer proximity of pivot 142 to pivot 140 than that of pivot 141 causes the rear extension link 123 to rise more than the front extension link 121, with the result that the headrest plate 111 pivots to a generally vertical position which is substantially parallel with the profile of this backrest. Thus, in the extended position, there is a substantial gap between the lower edge of the headrest plate 111 and the upper edge of the backrest side rail 102. The size of this gap can vary based on the style of chair used. Preferably, the gap is between 2.5 and 6 inches; more preferably, the gap is between about 3 and 4 inches.

Those skilled in the art will appreciate that the control assembly 125 serves to control the lateral movement of the upper portions of the front and rear extension links 121, 123, and that any means that properly controls the rear lateral movement of the rear extension arm 123 and front extension arm 121 while these links are elevated by the elevating link 140 is suitable. It should be noted that the control assembly 125 is functionally analogous to the pin 51 and the slot 36 of the first illustrated embodiment.

The foregoing embodiments are illustrative of the present invention, and are not to be construed as limiting thereof. The invention is defined by the following claims, with equivalents of the claims to be included therein.

That which is claimed is:

1. A headrest mechanism suitable for use in a seating unit comprising:

(a) a headrest plate movable between a retracted position and an extended position having a lower front edge;

(b) means for actuating said headrest plate between the retracted position and the extended position pivotally interconnected to said headrest plate;

(c) means adapted for fixedly mounting said headrest mechanism onto a seating unit pivotally connected to said actuating means;

wherein in the retracted position, said headrest plate is disposed generally horizontally, with said lower front edge being separated from a fixed point on said mounting means by a first distance, and in the extended position, said headrest plate is disposed generally vertically, with said lower edge being separated from said fixed point on said mounting means by a second distance, the second distance being between about 2.5 and 6 inches greater than the first distance.

2. The headrest mechanism defined in claim 1, wherein the second distance is between 3 and 4 inches greater than the first distance.

3. The headrest mechanism defined in claim 1, wherein said actuating means comprises:

(a) a front extension link pivotally interconnected with said headrest plate;

(b) a rear extension link pivotally interconnected with said headrest plate rearward of said front pivot link and slidably attached to said mounting means; and (c) linkage means for translating said front extension link substantially vertically for a third distance approximately equal to the difference between the first distance and the second distance, and for translating said rear extension link substantially vertically a fourth distance, the fourth distance being sufficiently greater than the third distance that said headrest plate pivots from a substantially horizontal disposition to a substantially vertical disposition.

4. The headrest mechanism defined in claim 3, wherein said translating linkage means comprises:

(d) an elevating link pivotally interconnected to said rear pivot link, pivotally interconnected to said front pivot link, and pivotally interconnected to said mounting means;

(e) control means for restricting lateral movement of said front extension link and said rear extension link.

5. The headrest mechanism defined in claim 4, wherein said control means comprises:

means pivotally and slidably interconnecting said rear extension link to said mounting means; and a slidable and pivotable interconnection between said front elevating link and said mounting means.

6. The headrest mechanism defined by claim 4, wherein said actuating means further comprises means adapted for coupling said actuating means with means for reclining a seating unit from an upright position to one or more reclined positions, and wherein said actuating means are adapted to be responsive to the reclining of such reclining means.

7. The headrest mechanism defined by claim 6, wherein said coupling means comprises:

(a) a bell crank pivotally interconnected to said mounting means and pivotally connected to said elevating link;

(b) a drive link pivotally interconnected to said bell crank intermediate of the pivots of said bell crank with said mounting means and said elevating link; and (c) a coupling bracket pivotally interconnected to said driving link and adapted to be mounted to means for reclining a seating unit.

8. A headrest mechanism suitable for use in a seating unit comprising:

(a) means adapted for mounting said headrest mechanism to a seating unit;

(b) an elevating link pivotally interconnected at its forward end with said mounting means;

(c) a rear extension link pivotally interconnected at its lowermost portion to said elevating link on the end thereof opposite said pivot with said mounting means;

(d) a front extension link pivotally interconnected at its lowermost portion to said elevating link intermediate said pivots thereon with said mounting means and said rear extension link;

(e) a headrest plate pivotally interconnected to said rear extension link and to said front extension link;

(f) means for pivoting said elevating link about said pivot with said mounting means, so that the pivoting of said elevating link causes said rear extension link to translate substantially vertically a first distance and said front extension link to translate substantially parallel to said rear extension link a second distance, said first distance being sufficiently greater than said second distance to pivot said headrest plate from a generally horizontally disposition to a generally vertical disposition.

9. The headrest mechanism defined in claim 8, wherein said means for pivoting said elevating link comprises:

(a) a bell crank pivotally interconnected with said mounting means and pivotally interconnected to said elevating link; and (b) means adapted for coupling said pivoting means with means for reclining a seating unit from an upright position to one or more reclined positions, and wherein said pivoting means are adapted to be responsive to the reclining movement of such reclining means.

10. The headrest mechanism defined in claim 9, wherein said coupling means comprises (a) a drive link pivotally interconnected to said bell crank intermediate of the pivots of said bell crank with said mounting means and said elevating link; and (b) a coupling bracket pivotally interconnected to said driving link and adapted to be mounted to means for reclining a seating unit.

11. A seating unit comprising:

(a) a seat frame including a backrest having an upper edge, a seat, and a base;

(b) a headrest plate movable between a retracted position and an extended position having a lower front edge;

(c) means for actuating said headrest plate between the retracted position and the extended position pivotally interconnected to said headrest plate;

(d) means for fixedly mounting said headrest mechanism onto said backrest of said seat frame pivotally interconnected to said actuating means;

wherein in the retracted position, said headrest plate is disposed generally horizontally and adjacently overlies said upper edge of said backrest, and in the extended position, said headrest plate is disposed generally vertically, with said lower front edge being separated from said upper edge of said backrest by a gap of between about 2.5 to 6 inches.

12. The seating unit defined in claim 11, wherein said seating unit further comprises upholstery fixed to said frame and tautly overlying said upper edge of said backrest and said headrest when said headrest is in the retracted position, and when said headrest is in the extended position, the substantial gap between said lower edge of said headrest and said upper edge of said backrest is sized sufficiently that said upholstery remains taut.

13. The seating unit defined in claim 11, wherein in the retracted position the gap between said upper edge of said backrest and said lower edge of said headrest plate is between about 3 and 4 inches.

14. The seating unit defined in claim 11, wherein said actuating means comprises:

(a) a front extension link pivotally interconnected to said headrest plate;

(b) a rear extension link pivotally interconnected to said headrest plate rearward of said front pivot link and slidably attached to said mounting means; and (c) linkage means for translating said front pivot link substantially vertically for a first distance approximately equal to the substantial gap between said lower edge of said headrest plate and said upper edge of said backrest in the extended position, and for translating said rear pivot link substantially vertically a second distance sufficiently greater than the first distance that said headrest plate pivots from a substantially horizontal disposition to a substantially vertical disposition.

15. The seating unit defined in claim 14, wherein said translating linkage means comprises:

(d) an elevating link pivotally interconnected to said rear pivot link, pivotally interconnected to said front pivot link, and pivotally interconnected to said mounting means; and (e) control means for restricting lateral movement of said front extension link and said rear extension link.

16. The seating unit defined in claim 15, wherein said control means comprises:

means pivotally and slidably interconnecting said rear pivot link to said mounting means; and wherein said elevating link is also slidably connected to said mounting means.

17. The seating unit defined in claim 11, wherein said frame further includes a footrest movable between a retracted vertical position below said seat and an extended horizontal position forward of said seat, and wherein said seating unit further comprises reclining linkage means for coordinating movement of said backrest, said seat, and said footrest relative to said base so that when said seating unit is in a first upright position, said backrest is in an upright position and said footrest is in its retracted position, and when said seating unit is in a reclined position, said backrest and said seat are in a reclined position, and said footrest is in its extended position, and wherein said actuating means further comprise means for responsively coupling the movement of said headrest plate to said coordinating linkage means so that when said seating unit is in its first upright position, said headrest plate is in its retracted position, and when said seating unit is in a reclined position, said headrest plate is in its extended position.

18. The seating unit defined in claim 17, wherein said reclining linkage means further comprises means for reclining said seat and said backrest to a plurality of reclined positions, and wherein said coupling means further comprise means responsive to said coordinating linkage means for maintaining the extended position of said headrest when said seating unit is in any of the plurality of reclined positions.

19. The seating unit defined in claim 18, wherein said reclining linkage means comprises linkage means for reclining said seat frame to a TV position and for further reclining said seat frame to a fully reclined position.

20. The seating unit defined in claim 19, wherein said backrest is pivotable about said seat so that in the upright positions, when viewed from side elevation, said backrest and said seat define a first angle, and in the fully reclined positions, said seat and said backrest define a second angle different from said first angle.

21. The seating unit defined in claim 17, wherein said reclining linkage means further comprises linkage wall avoiding means for limiting the rearward movement of said upper edge of said backrest relative to said base as said seating unit moves from the upright position to a reclined position.

22. The seating unit defined in claim 17, wherein said coupling means comprises:

(a) a drive link pivotally interconnected to said crank intermediate of the pivots of said crank with said mounting means and said elevating link; and (b) a coupling bracket link pivotally interconnected to said driving link and mounted to said coordinating linkage means.

23. A seating unit comprising:

(a) a seat frame including a backrest, a seat, and a base;

(b) mounting means fixed to said backrest of said seat frame;

(c) an elevating link pivotally interconnected at its forward end with said mounting means;

(d) a rear extension link pivotally interconnected at its lowermost portion to said elevating link on the end thereof opposite said pivot with said mounting means;

(e) a front extension link pivotally interconnected at its lowermost portion to said elevating link intermediate said pivots thereon with said mounting means and said rear extension link;

(f) a headrest plate pivotally interconnected to said rear extension link and to said front extension link;

(g) means for pivoting said elevating link about said pivot with said mounting means, so that the pivoting of said elevating link causes said rear extension link to translate substantially vertically a first distance and said front extension link to translate substantially parallel to said rear extension link a second distance, said first distance being sufficiently greater than said second distance to pivot said headrest plate from a generally horizontally position adjacent overlying said backrest to a generally vertical position.

24. The seating unit defined in claim 23, wherein said seating unit includes means for reclining the seating unit from an upright position to one or more reclined positions, and wherein said means for pivoting said elevating link comprises:

(a) a bell crank pivotally interconnected with said mounting means and pivotally interconnected to said elevating link; and (b) means for coupling said pivoting means with means for reclining a seating unit from an upright position to one or more reclined positions, and wherein said pivoting means are responsive to the reclining movement of such reclining means.

25. The seating unit defined in claim 24, wherein said coupling means comprises:

(a) a drive link pivotally interconnected to said bell crank intermediate of the pivots of said bell crank with said mounting means and said elevating link; and (b) a coupling bracket pivotally interconnected to said driving link and mounted to said reclining means.

26. A headrest mechanism suitable for use in a seating unit, said mechanism movable between a retracted and an extended position, comprising:

(a) means adapted for mounting said headrest mechanism to a seating unit;

(b) an elevating link pivotally interconnected at its forward end with said mounting at a first pivot, wherein said first pivot moves forwardly and reardwardly relative to said mounting means as said mechanism moves between the retracted and extended positions;

(c) a rear extension link pivotally interconnected with said elevating link on the end of said elevating link opposite said pivot with said mounting means;

(d) a front extension link pivotally interconnected with said elevating link intermediate said pivots thereon with said mounting means and said rear extension link;

(e) a headrest plate pivotally interconnected to said rear extension link and to said front extension link, said headrest plate being movable between the retracted position, in which said headrest plate is disposed generally horizontally, and the extended position, wherein said headrest plate is disposed generally vertically;

(f) means for actuating said elevating link about said first pivot;

wherein rotation of said elevating link about said first pivot causes said rear extension link to translate substantially vertically a first distance and said front extension link to translate substantially parallel to said rear extension link a second distance, said first distance being sufficiently greater than said second distance to pivot said headrest plate between retracted and extended positions.

27. The headrest mechanism defined in claim 26, wherein said means for actuating said elevating link comprises:

(a) a bell crank pivotally interconnected with said mounting means and pivotally interconnected to said elevating link; and (b) means adapted for coupling said pivoting means with means for reclining a seating unit from an upright position to one or more reclined positions, and wherein said actuating means are adapted to be responsive to the reclining movement of such reclining means.

28. The headrest mechanism defined in claim 27, wherein said coupling means comprises:

(a) a drive link pivotally interconnected to said bell crank intermediate of the pivots of said bell crank with said mounting means and said elevating link; and (b) a coupling bracket pivotally interconnected to said driving link and adapted to be mounted to means for reclining a seating unit.

29. A seating unit comprising:

(a) a seat frame including a backrest, a seat, and a base;

(b) mounting means fixed to said backrest of said seat frame;

(c) an elevating link pivotally interconnected at its forward end with said mounting at a first pivot, wherein said first pivot moves forwardly and rearwardly relative to said mounting means as said mechanism moves between the retracted and extended positions;

(d) a rear extension link pivotally interconnected with said elevating link on the end of said elevating link opposite said pivot with said mounting means;

(e) a front extension link pivotally interconnected with said elevating link intermediate said pivots thereon with said mounting means and said rear extension link;

(f) a headrest plate pivotally interconnected to said rear extension link and to said front extension link, said headrest plate being movable between the retracted position, in which said headrest plate is disposed generally horizontally, and the extended position, wherein said headrest plate is disposed generally vertically;

(g) means for actuating said elevating link about said first pivot;

wherein rotation of said elevating link about said first pivot causes said rear extension link to translate substantially vertically a first distance and said front extension link to translate substantially parallel to said rear extension link a second distance, said first distance being sufficiently greater than said second distance to pivot said headrest plate between retracted and extended positions.

30. The seating unit defined in claim 29, wherein said seating unit includes means for reclining the seating unit from an upright position to one or more reclined positions, and wherein said means for actuating said elevating link comprises:

(a) a bell crank pivotally interconnected with said mounting means and pivotally interconnected to said elevating link; and (b) means for coupling said actuating means with means for reclining a seating unit from an upright position to one or more reclined positions, and wherein said pivoting means are responsive to the reclining movement of such reclining means.

31. The seating unit defined in claim 30, wherein said coupling means comprises:

(a) a drive link pivotally interconnected to said bell crank intermediate of the pivots of said bell crank with said mounting means and said elevating link; and (b) a coupling bracket pivotally interconnected to said driving link and mounted to said reclining means.

* * * * *